US010992071B2

(12) United States Patent
Long et al.

(10) Patent No.: US 10,992,071 B2
(45) Date of Patent: Apr. 27, 2021

(54) FOUR-POST TERMINAL BLOCK AND ACCESSORIES FOR NONCONDUCTIVE PLANE APPLICATION

(71) Applicant: Siemens Mobility, Inc., New York, NY (US)

(72) Inventors: Zhenzhong Long, Louisville, KY (US); Barden J. Wing, New Albany, IN (US)

(73) Assignee: Siemens Mobility, Inc., New York, NY (US)

( * ) Notice: Subject to any disclaimer, the term of this patent is extended or adjusted under 35 U.S.C. 154(b) by 0 days.

(21) Appl. No.: 16/610,090

(22) PCT Filed: May 19, 2017

(86) PCT No.: PCT/US2017/033467
§ 371 (c)(1),
(2) Date: Nov. 1, 2019

(87) PCT Pub. No.: WO2018/212778
PCT Pub. Date: Nov. 22, 2018

(65) Prior Publication Data

US 2020/0091631 A1 Mar. 19, 2020

(51) Int. Cl.
*H01R 9/26* (2006.01)
*H01R 9/28* (2006.01)
*H01R 13/74* (2006.01)

(52) U.S. Cl.
CPC ..... *H01R 9/26* (2013.01); *H01R 9/28* (2013.01); *H01R 13/74* (2013.01)

(58) Field of Classification Search
CPC ... H01R 9/24; H01R 9/25; H01R 9/28; H01R 9/2608; H01R 9/2691; H01R 9/2408; H01R 9/2641; H01R 12/76; H01R 13/58; H01R 13/74; H01R 9/26
USPC ..... 439/716
See application file for complete search history.

(56) References Cited

U.S. PATENT DOCUMENTS 5,989,074 A 11/1999 Miller et al.
8,299,811 B2 10/2012 Wing et al.
8,670,221 B2 * 3/2014 Gillespie ..... H01R 9/2433 361/118
9,011,185 B2 * 4/2015 Diessel ..... H01R 9/2491 439/825
9,166,312 B2 * 10/2015 Bakatsias ..... H04B 1/3888
(Continued)

OTHER PUBLICATIONS

PCT International Search Report and Written Opinion of International Searching Authority dated Dec. 5, 2017 corresponding to PCT International Application No. PCT/US2017/033467 filed May 19, 2017.

*Primary Examiner* — Hien D Vu

(57) ABSTRACT

A terminal block for use with a railroad terminal board may include a terminal block body comprising first and second sides, a plurality of first connection posts extending from the first side of the body, and a second connection post extending from the second side of the body. The second connection post may be connected to one of the plurality of first connection posts. The second connection post may be configured to mount the terminal block to the railroad terminal board. The terminal block body may include a single hole extending through the first and second sides and configured to accept a mounting screw for mounting the terminal block to the railroad terminal board.

13 Claims, 6 Drawing Sheets

(56) References Cited

U.S. PATENT DOCUMENTS

| | | | | |
|---|---|---|---|---|
| 9,293,844 | B2 | 3/2016 | Wing et al. | |
| 9,831,570 | B2 * | 11/2017 | Habirov | H01R 9/2675 |
| 2015/0263442 | A1 | 9/2015 | Bakatsias et al. | |

* cited by examiner

FOUR-POST TERMINAL BLOCK AND ACCESSORIES FOR NONCONDUCTIVE PLANE APPLICATION

BACKGROUND

Terminal boards, including terminal blocks for terminating and testing of underground railroad wires connected to signals, track circuits, and other devices on the railroad track or along the wayside, are generally protected by and provided within a bungalow or similar structure at various locations along the railroad track. Current terminal board configurations may include multiple terminal blocks installed on a terminal plane. A four-post terminal block usually includes posts for equipment, ground, line, and test connections. The posts extend from the front side of the block's body so that the various connections can be made inside the bungalow. The back side of the terminal block is mounted to the terminal plane using mounting screws. One or more underground cables are routed through the floor or a wall of the bungalow through the terminal plane and connected to respective posts on the front side of the terminal blocks. Factory wiring is connected to posts at the front side of the terminal block and to equipment inside the bungalow for providing power and/or control signals to the equipment located on the track or along the wayside.

DETAILED DESCRIPTION OF SEVERAL EMBODIMENTS

Embodiments described herein relate to railroad equipment such as terminal blocks used with terminal boards. For example, some embodiments may include a four-post terminal block with a plurality of through posts configured for non-metal plane applications. Terminal blocks may be used with railroad terminal boards. A terminal block may comprise a terminal block body having first and second sides; a plurality of first connection posts extending from the first side of the body; and a plurality of second connection posts extending from the second side of the body, each of the plurality of second connection posts being connected to a respective one of the plurality of first connection posts. The terminal blocks described herein may include specific features making them suitable for attachment to non-metal planes. These terminal blocks may be contrasted with terminal blocks for use with metal planes, such as those described in U.S. Pat. No. 9,293,844, the entirety of which is incorporated by reference herein.

Figure 1:
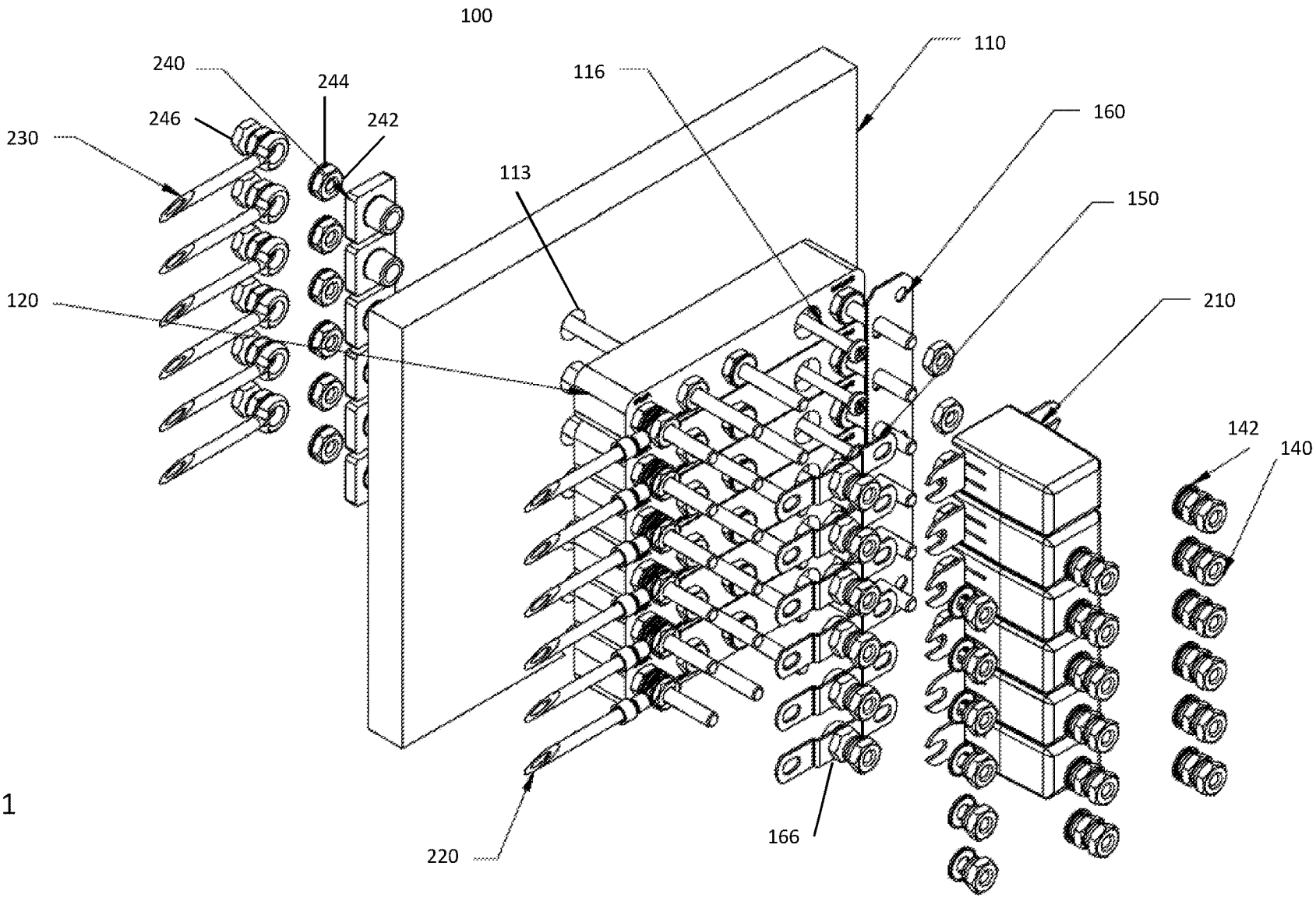
FIG. 1 illustrates a terminal board including a plurality of four-post terminal blocks according to an embodiment disclosed herein.

FIG. 1 illustrates an example of a terminal board 100 constructed in accordance with an embodiment disclosed herein. The terminal board 100 includes a terminal board plane 110, which may be formed of a non-conductive material (e.g., plywood or phenolic material). The plane 110 may be mounted on, or form part of, a vertical wall or frame located within a bungalow (not shown) such that the front of the plane 110 may be accessed when entering the bungalow through a front entrance and a back of the plane 110 may be accessed from a rear entrance of the bungalow or by walking around the wall or frame. In some embodiments, several rows of four-post terminal blocks 120 may be mounted on the plane 110, with the terminal blocks 120 in one horizontal row in close proximity to, and in some cases in contact with, terminal blocks 120 in a vertically adjacent row. For example, some configurations may include 12 or 24 rows of terminal blocks 120. Some configurations may include 2 to 6 rows of terminal blocks 120.

Figure 2:
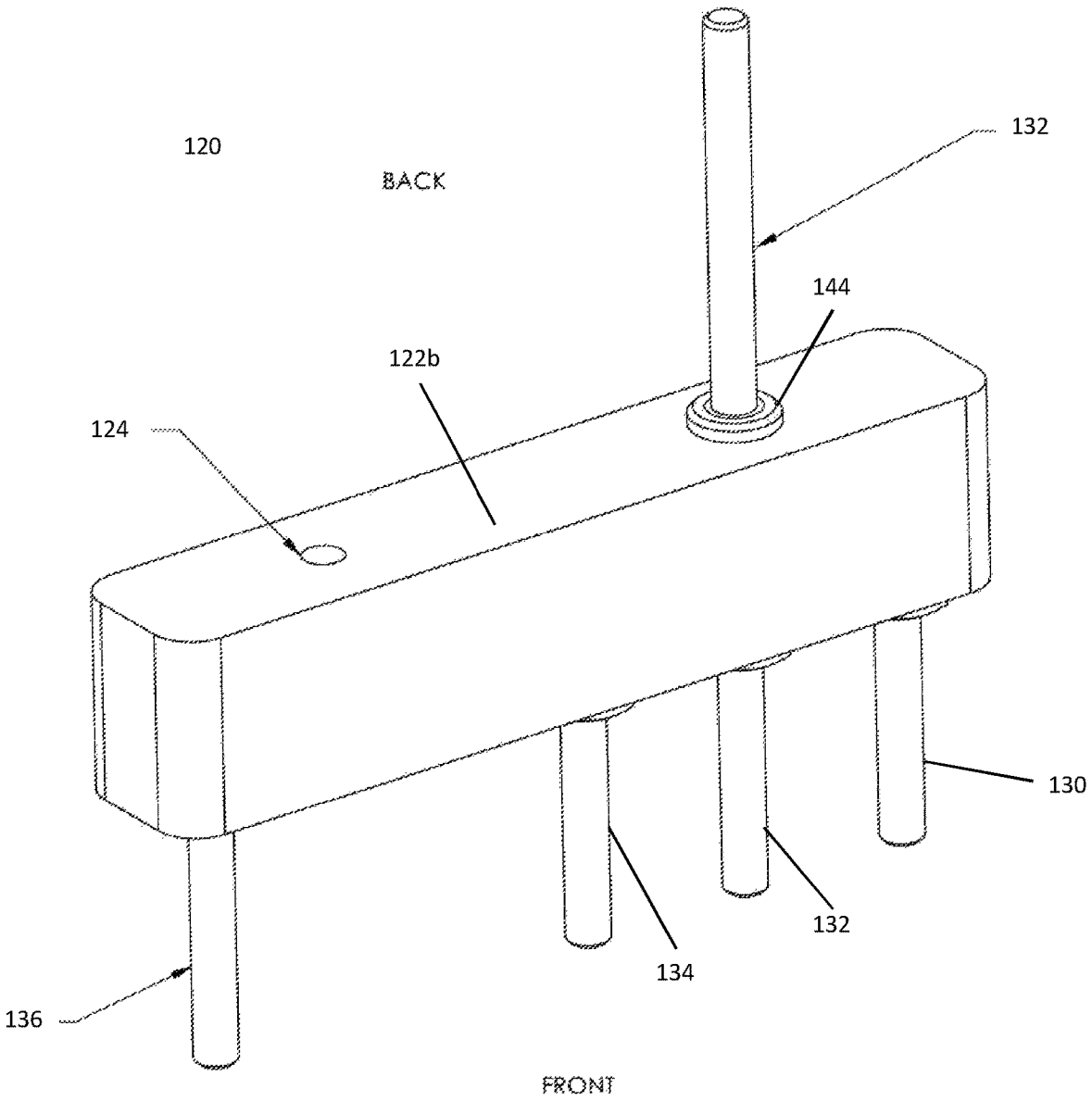
FIGS. 2 and 3 illustrate an example terminal block according to an embodiment disclosed herein and included in the terminal board of FIG. 1.
Figure 3:
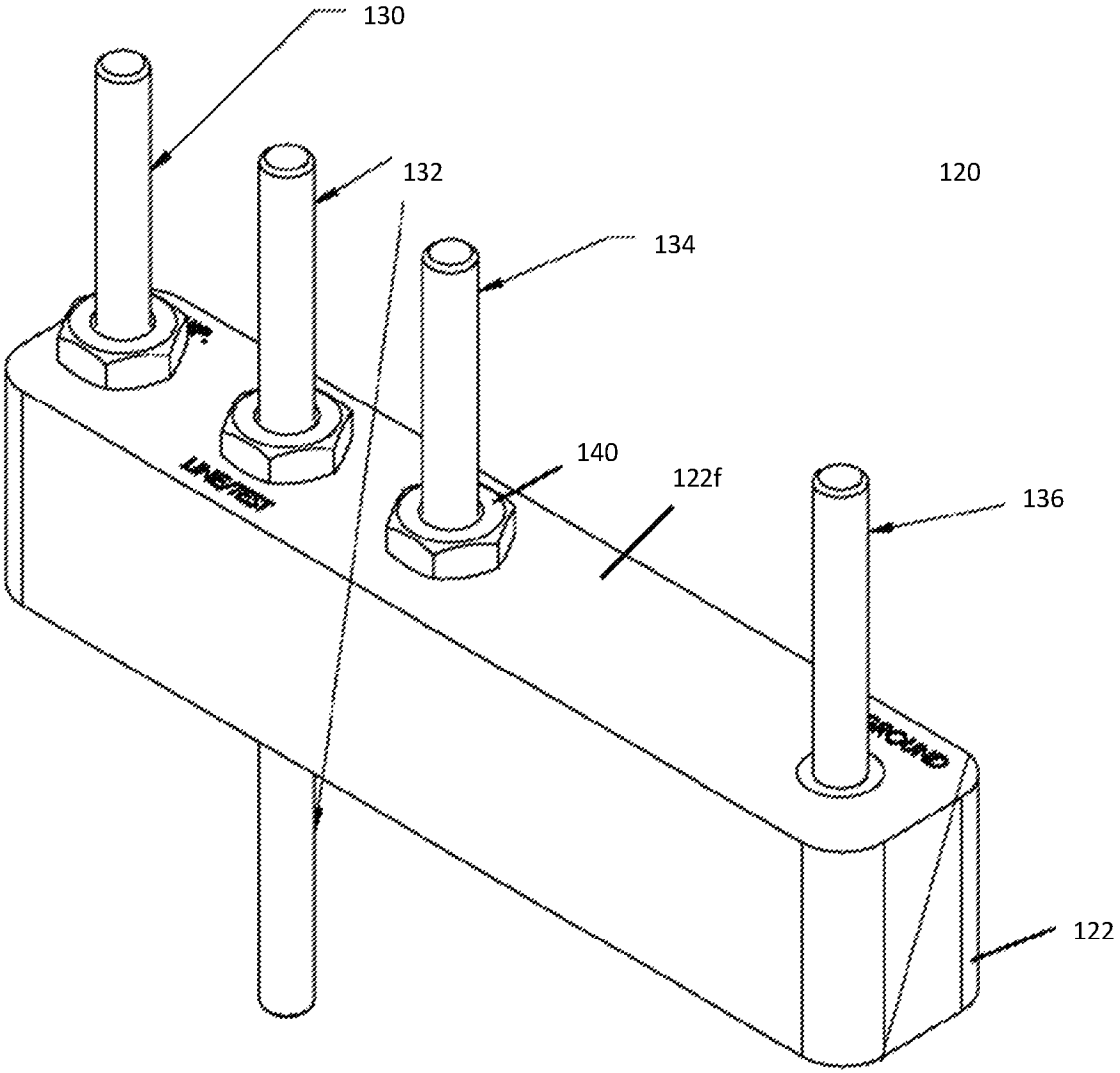

FIGS. 2 and 3 illustrate details of a terminal block 120. The terminal block 120 may include a body 122 having a front 122*f* and a back 122*b*. Four posts 130, 132, 134, 136 may extend from the front 122*f* of the body 122. The posts 130, 132, 134, 136 may be formed of a bronze rod or other conductive rod. Each post 130, 132, 134, 136 may be threaded, for example with a thread approved by AREMA (American Railway Engineering and Maintenance-of-Way Association). In the illustrated example, the first post 130 is an equipment post, the second post 132 is a line/test post, the third post 134 is a surge protection component mounting post, and the fourth post 136 is a grounding post. The line/test post 132 may extend through the body 122 and from the back 122*b* of the body 122. In some embodiments, the line/test post 132 may be two pieces respectively extending from the back 122*b* and front 122*f* of the body 122 with internal wiring (not shown) connecting the two pieces electrically. The function and use of equipment, ground, line, and test posts for a railroad application are well known in the art and are not discussed further herein.

The terminal block body 122 may include a hole 124 for mounting the terminal block 120 to the plane 110 using e.g., screws 116 (illustrated in FIG. 1). Nuts 140 and washers 142 may be used with the posts 130, 132, 134, 136 when making connections to cabling or other devices (e.g., test links, lightning arresters, equalizers, etc.).

As can be seen in FIG. 2, a back shoulder 144 may be formed on or placed on the back side 122*b* of the body 122 around the post 132. The back shoulder 144 may be formed of insulting material and may electrically isolate the body 122 from the plane 110. The back shoulder 144 may be sized to fit through a corresponding hole 113 (FIG. 1) in the plane 110 when the terminal block 120 is installed on the plane 110. As described in detail below, due to the configuration of the terminal board 100 and terminal block 120, specifically the hole 124 and through post 132 on the back side 122*b* of the block 120, the terminal block 120 can be easily installed directly to an insulator plane 110. Nuts 140 and washers (not shown in detail) may be used with the posts 130, 132, 134, 136 when making connections to cabling or other devices (e.g., test links, lightning arresters, equalizers, etc.).

Referring again to FIG. 1, the ground posts 136 of installed terminal blocks 120 may be connected to each other by a ground strap 160 having connection holes configured to accept the ground posts 136. The ground strap 160 may be connected to ground to provide the grounding path for the components of the terminal board 100.

Figure 5A:
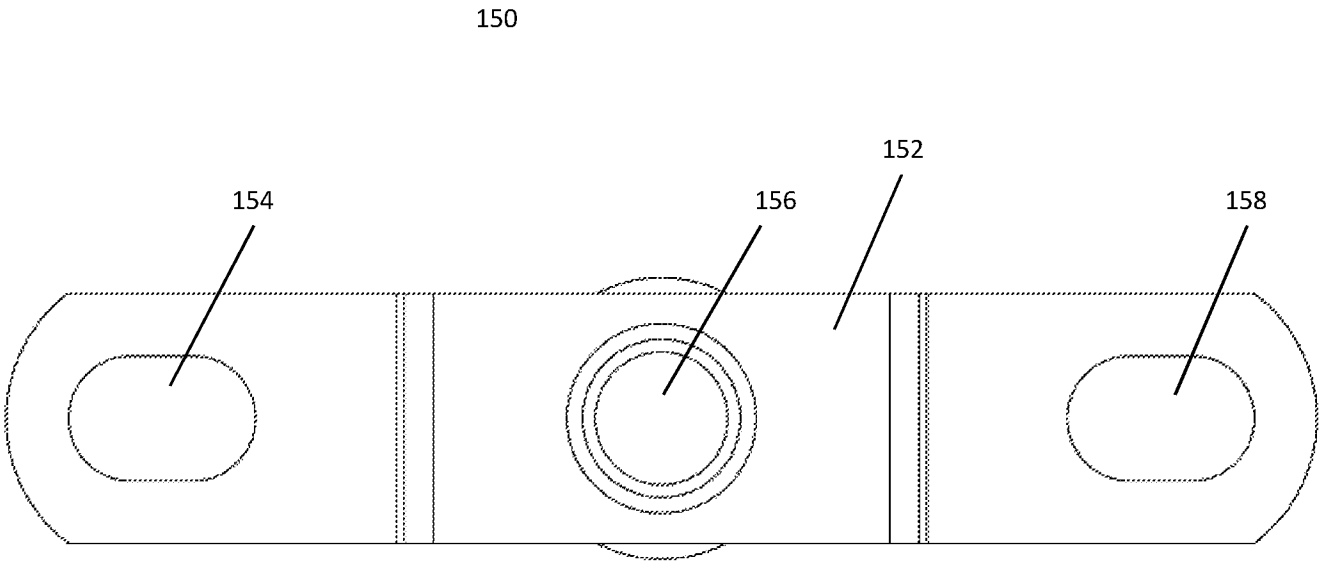
FIGS. 5A and 5B illustrate an example test link according to an embodiment disclosed herein and included in the terminal board of in FIG. 1.
Figure 5B:
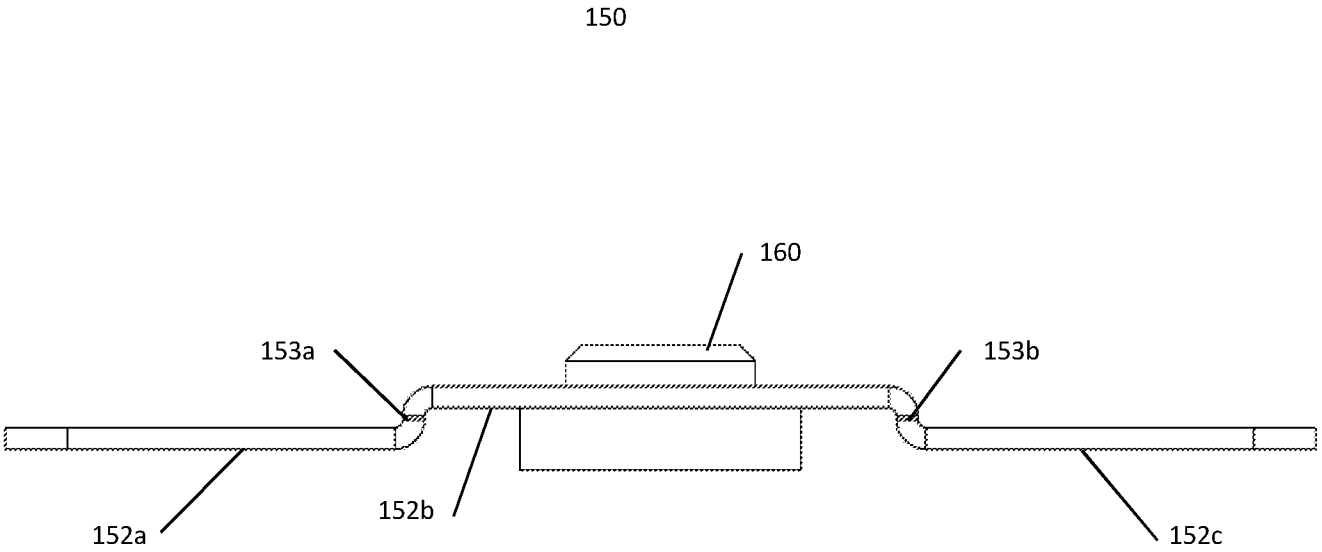

Referring to FIGS. 1, 5A, and 5B. an insulated test link 150 may be provided for each terminal block 120 used with the terminal board 100. Each test link 150 may include a body 152 comprising three horizontal portions 152*a*, 152*b*, 152*c* that are offset from each other. The first portion 152*a* may have a first hole 154 that is sized to accept the first front post 130. The first portion 152*a* may be connected to the second portion 152*b* by a first vertical wall 153*a*. The second portion 152*b* may be offset from the first portion 152*a* by the length of the first vertical wall 153*a*. The second portion 152*b* may include a second hole 156 that is sized to accept the second front post 132. The second portion 152*b* may be connected to the third portion 152*c* by a second vertical wall 153*b*. The third portion 152*c* may be offset from the second portion 152*b* by the length of the second vertical wall 153*b*. The third portion 152*c* may include a third hole 158 that is sized to accept the third front post 134. The test link 150 may be a 3-way test link because it interconnects three front posts (i.e., equipment post 130, line/test post 132 and surge protection component mounting post 134). Because of this 3-way connection, internal wiring between the posts may be unnecessary.

The second hole 156 may be lined with an insulating material 160. The insulating material 160 may electrically isolate the test link 150 from the second post 132 unless a test nut 166 is installed on the second post 132 and over the test link 150. When the test nut 166 is installed, the test link 150 may connect the first, second, and third posts 130, 132, 134. The test link 150 may be installed at the factory, plant, or other facility before the terminal board 100 and/or terminal blocks 120 are installed in the field.

Figure 4:
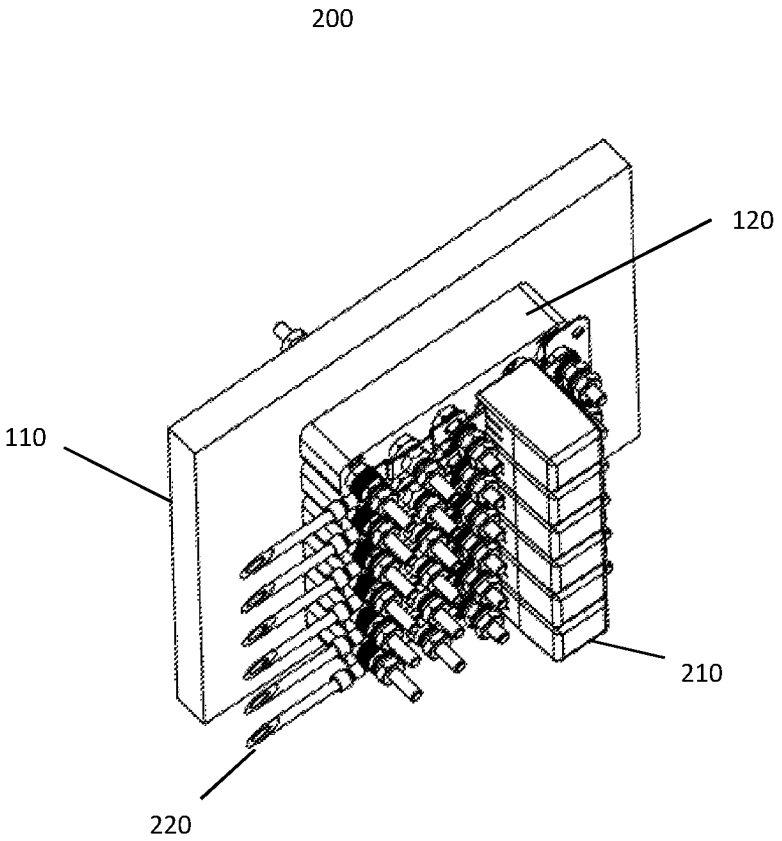
FIG. 4 illustrates a terminal board assembly comprising the terminal board of FIG. 1 according to an embodiment disclosed herein.

FIG. 4 illustrates a terminal board assembly 200 comprising the terminal board 100 illustrated in FIG. 1. In addition to the terminal board 100, the terminal board assembly 200 may include surge protection components 210 connected between the third and fourth posts 134, 136 of respective terminal blocks 120 by washers 142 and nuts 140 sized to fit over the posts 134, 136. The surge protection component 210 may be e.g., a lightning arrester and/or an equalizer. In addition, the assembly 200 may include first wiring or cable 220 connected to the first front posts 130 of respective terminal blocks 120 by washers 142 and nuts 140 sized to fit over the first post 330. The first wiring 220 may be factory wire, pre-installed as part of the terminal board assembly 200 prior to installation in the field. The wiring 220 may be connected to control equipment located inside the bungalow.

In some cases, one or more terminal blocks 120 can be mounted to the terminal board plane 110 at the factory or other facility prior to installing the terminal board 100 in the field. Referring to FIG. 1, to mount a terminal block 120 to the terminal board plane 110, the portion of second post 132 extending from the back side 122*b* of body 122 may be passed through a hole 113 in the plane 110. The back shoulder 144 may also enter the hole 113. An insulation square (or plug of another shape) 240 may be fitted around the second post 132 such that a convex portion of the insulation plug 240 extends into the hole 113, surrounding the second post 132 and abutting the back shoulder 144 (which also extends into the hole 113). The insulation plug 240 and back shoulder 144 may fit snugly against the inside of the hole 113 in some embodiments. The insulation plug 240 and back shoulder 144 may isolate the second post 132 from the plane 110. A nut 242 and washer 244 may be used to complete the connection of the terminal block 120 to the terminal board plane 110. A screw 116 may be inserted through the installation hole 124 and a hole in the plane 110 (not visible in FIG. 1) to fasten the terminal block 120 to the plane 110 at a second position. The same installation procedure may be performed for all of the terminal blocks 120 that are to be installed on the terminal board 100. The wiring 220, test link 150, and surge protection component 210 for each terminal board 120 may be installed after mounting the block 120 to the plane 110. Once the bungalow with the terminal board 100 is installed in the field, external cabling 230 may be connected to the backs of second posts 132 with nuts 246 and washers.

The terminal block 120 configured for installation on non-conductive terminal board planes 110 may include several advantageous features (e.g., relative to embodiments of FIGS. 1-4 of U.S. Pat. No. 9,293,844, referenced above). For example, the underground cabling 230 may be installed on the back of the terminal board plane 110 by railroad personnel in the field. Since the cabling 130 is installed on the back of the terminal board plane 110, it is not necessary to pull the cable through holes to the front of the plane 110 for termination. Thus, field installation may be simplified and installation time may be be reduced. Moreover, as mentioned above, the hardware (terminal blocks, test links, arrestors etc.) can be installed on the front of the terminal board plane 110 in the factory, further reducing field installation time.

As described above, the second post 132 and screw 116 may be used to mount the terminal blocks 120 to the terminal board 100. This may eliminate the need for additional terminal board plane 110 support and mounting screws. Moreover, the second post 132 allows a direct connection to the wiring 230 on the rear of the terminal board plane 310.

The terminal block 120 may eliminate the need for internal wiring and may provide a more definitive separation between the "clean" (case) wires on the front of the terminal board plane 110 and the "dirty" (underground) cables on the back, which is a requirement of some railroads.

While various embodiments have been described above, it should be understood that they have been presented by way of example and not limitation. It will be apparent to persons skilled in the relevant art(s) that various changes in form and detail can be made therein without departing from the spirit and scope. In fact, after reading the above description, it will be apparent to one skilled in the relevant art(s) how to implement alternative embodiments.

In addition, it should be understood that any figures which highlight the functionality and advantages are presented for example purposes only. The disclosed methodology and system are each sufficiently flexible and configurable such that they may be utilized in ways other than that shown.

Although the term "at least one" may often be used in the specification, claims and drawings, the terms "a", "an", "the", "said", etc. also signify "at least one" or "the at least one" in the specification, claims and drawings.

Finally, it is the applicant's intent that only claims that include the express language "means for" or "step for" be interpreted under 35 U.S.C. 112(f). Claims that do not expressly include the phrase "means for" or "step for" are not to be interpreted under 35 U.S.C. 112(f).

What is claimed is:

1. An electrical terminal board for railroad equipment, the electrical terminal board comprising:

a plane constructed from a non-conductive material and having an external wiring on a rear of the plane; and at least one terminal block mounted to the plane via a single mounting screw, each the at least one terminal block comprising:

a terminal block body comprising first and second sides;

a plurality of first connection posts extending from the first side of the terminal block body; and a second connection post extending from the second side of the terminal block body, the second connection post being connected to one of the plurality of first connection posts, the second connection post being configured to mount the at least one terminal block to the plane, wherein the second connection post provides a direct connection to the external wiring on the rear of the plane;

wherein the terminal block body includes a single hole extending through the first and second sides and configured to accept the single mounting screw for mounting the at least one terminal block to the terminal board.

2. The electrical terminal board of claim 1, wherein the plurality of first connection posts of each at least one terminal block comprises four first connection posts.

3. The electrical terminal board of claim 1, wherein the first and second connection posts of each at least one terminal block are made of bronze.

4. The electrical terminal board of claim 1, wherein each at least one terminal block further comprises an insulated shoulder around the second connection post and in contact with the second side of the terminal block body.

5. The electrical terminal board of claim 4, wherein:

the plane comprises at least one hole corresponding to the at least one terminal block;

each insulated shoulder is disposed within one of the at least one holes; and the terminal board further comprises an insulating plug for each at least one hole, each insulating plug being disposed within one of the at least one holes and separating one of the second connection posts from the plane.

6. The electrical terminal board of claim 5, wherein the at least one terminal block is configured to be mounted to the plane by:

passing the second connection post through one of the at least one holes in the plane and securing the second connection posts; and securing the terminal block to the plane with the mounting screw.

7. The electrical terminal board of claim 1, wherein the at least one terminal block further comprises:

a three-way test link provided over three first connection posts; and a test nut provided over one of the first connection posts to establish a conductive path between the three first connection posts.

8. The electrical terminal board of claim 1, further comprising a ground strap provided over one of the first connection posts of each terminal block and coupled to ground.

9. An electrical terminal board assembly for railroad equipment, the electrical terminal board assembly comprising:

a terminal board comprising a plane, wherein the plane is constructed from a non-conductive material and having an external wiring on a rear of the plane;

a single mounting screw;

at least one terminal block mounted to the plane via the single mounting screw, each the at least one terminal block comprising:

a terminal block body comprising first and second sides;

a plurality of first connection posts extending from the first side of the terminal block body; and a second connection post extending from the second side of the terminal block body, the second connection post being connected to one of the plurality of first connection posts, the second connection post being configured to mount the terminal block to the plane, wherein the second connection post provides a direct connection to the external wiring on the rear of the plane;

wherein the terminal block body includes a single hole extending through the first and second sides and configured to accept the single mounting screw for mounting the terminal block to the railroad terminal board;

a three-way test link provided over three first connection posts;

a test nut provided over one of the first connection posts to establish a conductive path between the three first connection posts;

a ground strap provided over one of the first connection posts of the at least one terminal block and coupled to ground; and at least one surge protection component connected to the at least one terminal block, the at least one surge protection component being provided between one of the first connection posts connected to the three-way test link and one of the first connection posts not connected to the three-way test link.

10. The electrical terminal board assembly of claim 9, further comprising first wiring connected to a first connection post that is connected to the three-way test link.

11. The electrical terminal board assembly of claim 9, wherein the at least one terminal block further comprises an insulated shoulder around the second connection post and in contact with the second side of the terminal block body.

12. The electrical terminal board assembly of claim 11, wherein:

the plane comprises at least one hole corresponding to the at least one terminal block;

each insulated shoulder is disposed within one of the at least one holes; and the terminal board further comprises an insulating plug for each at least one hole, each insulating plug being disposed within one of the at least one holes and separating one of the second connection posts from the plane.

13. The electrical terminal board assembly of claim 11, wherein the at least one terminal block is configured to be mounted to the plane by:

passing the second connection post through one of the at least one in the plane and securing the second connection posts; and securing the at least one terminal block to the plane with the mounting screw.

* * * * *